US005743430A

United States Patent [19]

Freixas

[11] Patent Number: 5,743,430

[45] Date of Patent: Apr. 28, 1998

[54] AUTOMATIC DRINKING STRAW DISPENSING DEVICE

[76] Inventor: Oscar Freixas, 11277 SW. 88th St., #K-105, Miami, Fla. 33176

[21] Appl. No.: 612,428

[22] Filed: Mar. 7, 1996

[51] Int. Cl.[6] ..... A47F 1/00

[52] U.S. Cl. ..... 221/97; 221/194

[58] Field of Search ..... 221/194, 195, 221/97, 98, 102, 266, 268, 277

[56] References Cited

U.S. PATENT DOCUMENTS 2,511,951 6/1950 Solomon ..... 221/266
5,127,543 7/1992 Meisels ..... 221/97

*Primary Examiner*—Kenneth Noland
*Attorney, Agent, or Firm*—Malloy & Malloy,P.A.

[57] ABSTRACT

An automatic drinking straw dispensing device to be mounted within a vending machine and dispense a drinking straw in a generally horizontal configuration, the device including a primary receptacle structured to contain a plurality of the drinking straws therein for individual dispensing through a generally elongate slot formed at a bottom of the primary receptacle. The dispensing device further includes a dispensing platform positioned in dispensing communication with the elongate slot such that the drinking straws which pass through the elongate slot are directed onto the dispensing platform and are retained in an accessible, retrievable orientation. Also, in order to prevent more than one of the drinking straws from backing up on the dispensing platform and in order to ensure that a fresh one of the drinking straws is always available for retrieval, the automatic drinking straw dispensing device is equipped to remove the dispensed one of the drinking straws from the dispensing platform into a recycling bin if it is not retrieved after a predetermined period of time.

23 Claims, 3 Drawing Sheets

AUTOMATIC DRINKING STRAW DISPENSING DEVICE

BACKGROUND OF THE INVENTION

1. Field of the Invention

The present invention relates to an automatic drinking straw dispensing device which can effectively and sanitarily dispense a drinking straw, stirrer, or rolled napkin assembly, automatically and efficiently, without taking up substantial amounts of space, such upon the purchase of a beverage or other article from a vending machine at a remote location a consumer has such products easily available for use.

2. Description of the Related Art

Drinking straws are frequently utilized to assist with beverage consumption, and in particular many individuals prefer the use of drinking straws when drinking from a container such as a bottle or can. Specifically, because bottles, and cans especially, are frequently distributed by a dispensing machine, and a user must generally place their mouth on an exterior, exposed portion thereof during drinking, many persons prefer to utilize straws for sanitary purposes. Furthermore, a can or bottle can sometimes include a sharp surface which may injure an individual, or may be uncomfortable to drink as a person's mouth generally covers the entire opening and makes it difficult to sip the liquid due to the lack of an air inlet. As a result, most commercial establishments make straws available to their consumers in order to satisfy their sanitary preferences. For example, it is a frequent occurrence that a large dispensing assembly be placed on a counter such that an individual, merely by depressing a lever or turning a knob my effectively dispense a clean drinking straw for their consumption needs.

One commercial location at which drinking straws are not make readily available, however, relates to automatic dispensing machines. Because such machines do not require an attendant be present, and are generally positioned outside or in a confined area, drinking straws are generally not made available, partly for fear that another will tamper with the drinking straws or will take excessive quantities of the drinking straws such that they will not be available for subsequent consumers, and partly because of the limited or non-existing counter space available at the site of the machine. Accordingly, individuals receiving a beverage from an automatic dispenser are generally left to find their own straws or a napkin so as to wipe down the surface of the can around the opening.

Generally, most conventional drinking straw dispensing devices are manually actuated bins wherein an individual may pull/push on a lever or turn a knob in order to dispense a straw for their use. A consumer is able to take as many straws as they desire, and generally the bins are located on a counter top or other location such that an employee can ensure that the dispenser is not tampered with or unnecessarily emptied. Unfortunately, however, there is a substantial need in the art for a compact and conveniently useable dispensing assembly which can be implemented with an automatic beverage dispensing machine. Such a device should be able to fit conveniently within existing beverage dispensing machines without taking up substantial space, and be safe and efficient, ensuring that it cannot be un-necessarily emptied.

In the past, another had attempted to develop automated dispensing machines to dispense a drinking straw. In particular, the reference to Yingst et al. (U.S. Pat. No. 3,519,166) discloses a drinking straw dispenser to be utilized with a vending machine. However, such a device dispenses the straws endwise, thereby requiring a substantial amount of space within the vending machine housing be allocated for the straw dispensing assembly, as it is structured to pivot the straw outwardly for dispensing. Furthermore, such a device can easily become backed up if a user does not actually remove the straw dispensed to them. Specifically, as a subsequent straw is dispensed, if the previously dispensed straw was not retrieved the new straw will merely push the previously dispensed straw out onto the ground. Moreover, the opening from which the dispensed straw is pulled is not configured so as to prevent tampering with a straw contained therein such that a mischievous individual may tamper with a straw, but not remove it, and it will be dispensed subsequently to a further unsuspecting consumer.

Accordingly, there is a substantial need in the art for an automatic drinking straw dispensing device which can take up minimal space within an automatic dispensing machine, and which conveniently positions the straw for retrieval by consumer. Furthermore, such a device should simple and inexpensive, and provide minimal risk of tampering with the straw or backing up of un-retrieved straws. The device of the present invention is such a product.

SUMMARY OF THE INVENTION

The present invention relates to an automatic drinking straw dispensing device preferably structured to be mounted within an inside cover of a conventional beverage dispensing machine. Specifically, the automatic drinking straw dispensing device includes a primary receptacle. The primary receptacle is structured and disposed to contain a plurality of straws to be dispensed therein. Furthermore, the primary receptacle includes a generally elongate slot. The elongate slot is positioned within the primary receptacle so as to permit the passage of drinking straws conveniently and effectively therethrough in a generally longitudinal, rolling manner.

Connected in dispensing communication with the elongate slot of the primary receptacle is a dispensing platform. The dispensing platform is disposed so that the drinking straws which pass through the elongate slot are directed thereon and are positioned for convenient retrieval by consumer. Furthermore, in order to ensure that only one drinking straw exits the primary receptacle to the dispensing platform through the elongate slot at one time, single straw dispensing means are included. Accordingly, upon actuation by a user or as directed by the purchase of a beverage, the single straw dispensing means are structured to permit only one drinking straw to pass through the elongate slot onto the dispensing platform where it will be maintained in an accessible, retrievable orientation.

Additionally, in order to prevent more than one of the drinking straws from backing up on the dispensing platform, and further to ensure that a fresh one of the drinking straws is available for retrieval, the automatic drinking straw dispensing device of the present invention includes recycling means. Specifically, the recycling means are structured and disposed to remove the dispensed one of the drinking straws from the dispensing platform if it is not retrieved by the user subsequent to a beverage being dispensed by the vending machine.

It is an object of the present invention to provide an automatic drinking straw dispensing device which is substantially compact so as to be conveniently disposed within a beverage vending machine.

A further object of the present invention is to provide an automatic drinking straw dispensing device which dispenses the drinking straws in a generally longitudinal orientation thereby minimizing an overall depth thereof and facilitating convenient positioning within a vending machine.

A further object of the present invention is to provide an automatic drinking straw dispensing device which is capable of removing unretrieved drinking straws from a dispensed orientation, thereby ensuring that a drinking straw maintained in a dispensed orientation is not tampered with and that a plurality of the drinking straws do not backup in a dispensed orientation if not retrieved.

An additional object of the present invention is to provide an automatic drinking straw dispensing device structured to substantially prevent tampering with a drinking straw disposed in a dispensed orientation.

Also an object of the present invention is to provide an automatic drinking dispensing device which is capable of reloading unused straws for re-dispensing at a subsequent time.

Another object of the present invention is to provide an automatic drinking straw dispensing device which is also capable of dispensing stirrers for use with a coffee or tea dispensing machine.

Yet another object of the present invention is to provide an automatic drinking straw dispensing device which is capable of dispensing rolled napkin assemblies and a variety of other articles disposed in a generally rolled orientation conveniently and effectively.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The present invention is directed towards an automatic drinking straw dispensing device, generally indicated as 10. Although the automatic drinking straw dispensing device 10 of the present invention may be an independent, free standing unit, in the preferred embodiment it will preferably be mounted as part of an automatic dispensing machine 85, which is structured to dispense a beverage with which the drinking straw is to be utilized. As such, the automatic drinking straw dispensing device 10 of the present invention may be connected with the controls of the vending machine 85 for various features thereof.

In particular, the automatic drinking straw dispensing device 10 of the present invention includes a primary receptacle 20. The primary receptacle 20 defines a large open interior compartment 25 and is therefore structured to contain a plurality of drinking straws A therein, in a ready to be dispensed orientation. The drinking straws themselves, may be contained unwrapped or wrapped, so long as in either configuration they are able to roll or slide down a sloped surface. Further, the primary receptacle 20 preferably includes a generally elongate configuration so as to accommodate a length of the drinking straws, however is also generally shallow from a front surface to a rear surface such that it will not take up substantial amounts of space into the vending machine 85 wherein it is mounted.

Figure 3:
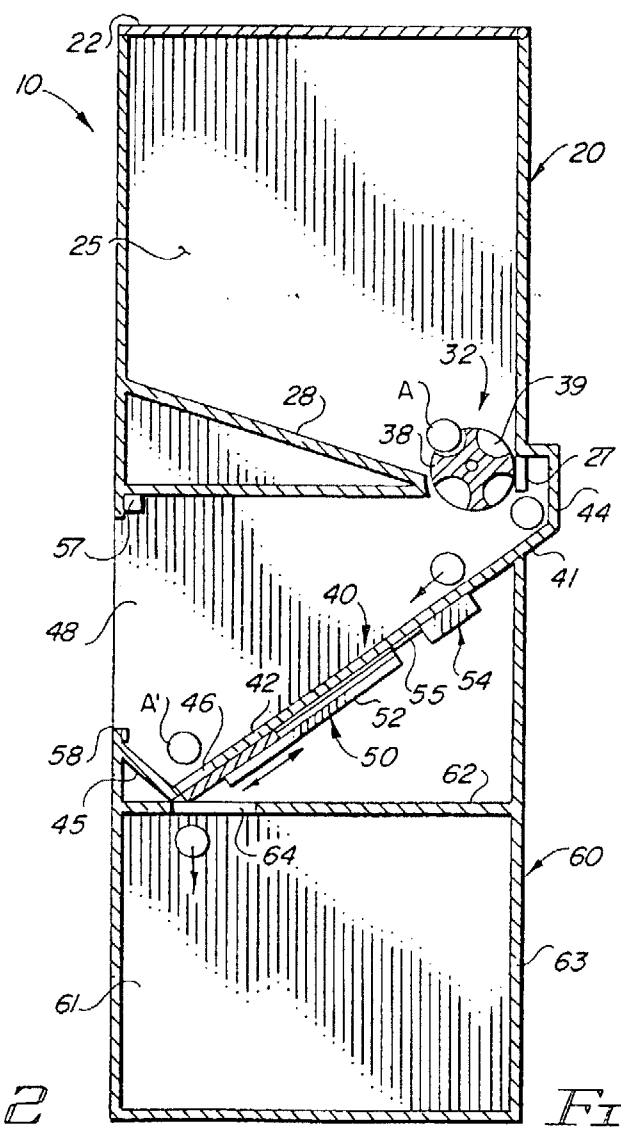
FIG. 3 is a side, cross-section view of another embodiment of the automatic drinking straw dispensing device of the present invention.
Figure 2:
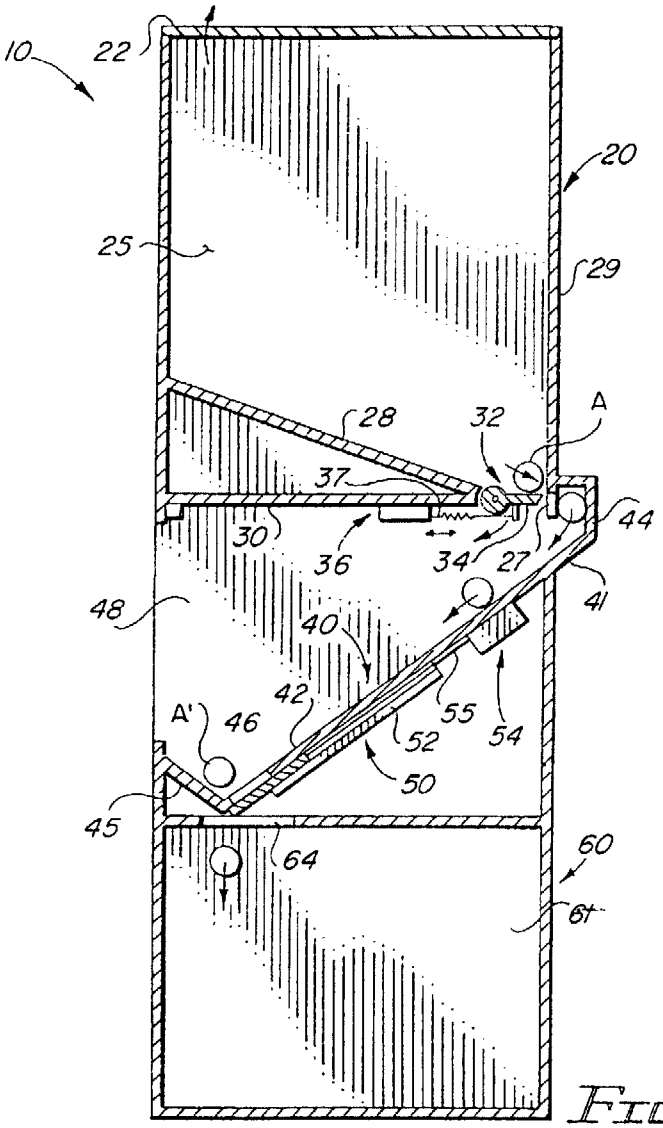
FIG. 2 is a side, cross-section view of a first preferred embodiment of the automatic drinking straw dispensing device of the present invention.
Figure 5:
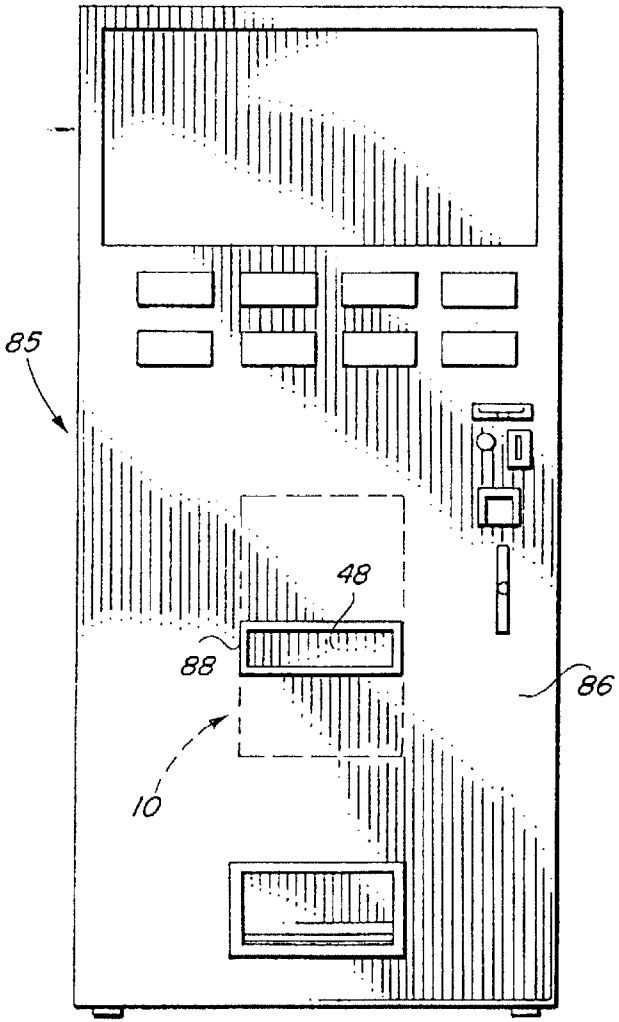
FIG. 5 is a front view of a vending machine including the automatic drinking straw dispensing device of the present invention mounted therein.
Figure 4:
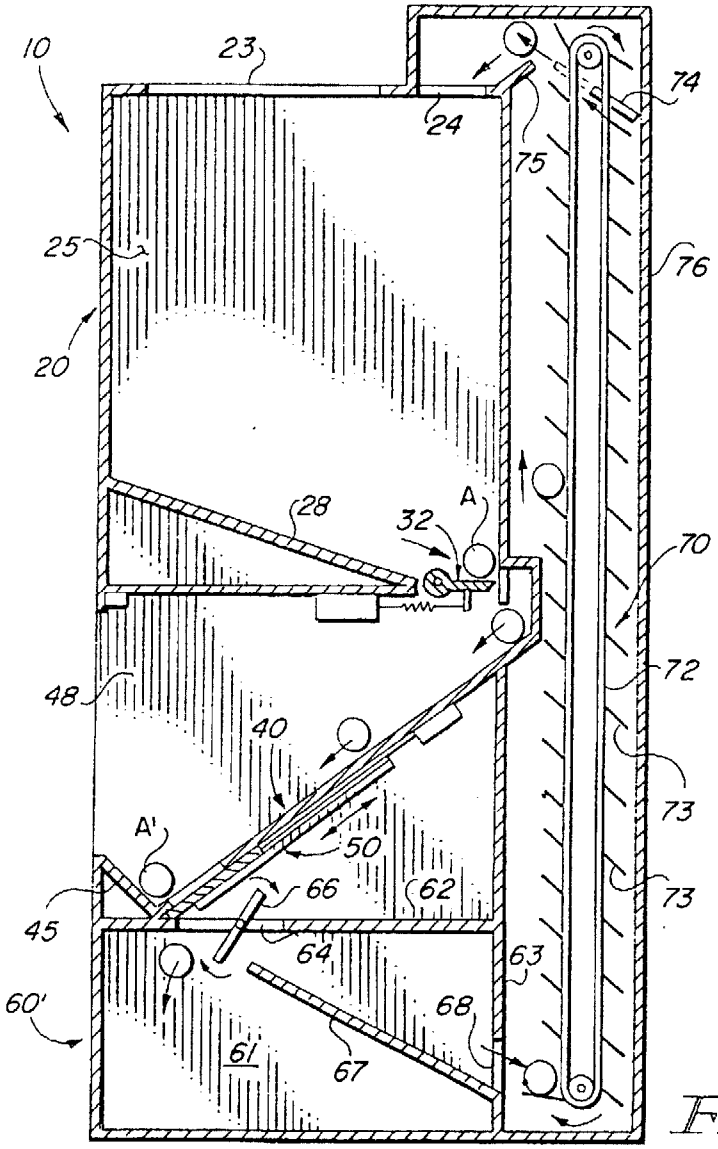
FIG. 4 is a side, cross-section view of a yet another embodiment of the automatic drinking straw dispensing device of the present invention.

So as to provide access to the open interior compartment 25 of the primary receptacle 20, the primary receptacle 20 preferably includes an open top surface 21 structured to permit reloading of drinking straws therethrough into the open interior compartment 25 of the primary receptacle 20. Although the open top surface 21 may be completely and permanently opened, in an alternative embodiment, as illustrated in FIGS. 2 and 3, a hinged or otherwise openable cover 22 may be disposed in covering relation atop the open top surface 21, thereby maintaining an enclosed, cleaner environment within the open interior compartment 25. Also, as illustrated in FIG. 4, a generally smaller reloading opening 23 be may defined in a top surface of the primary receptacle 20 to permit access to the interior compartment 25 when reloading straws.

As illustrated in the Figures, the primary receptacle 20 preferably includes a generally slopped bottom surface 28. This slopped bottom surface 28, may be the actual bottom surface of the primary receptacle 20, or may merely be a ramped segment secured within the interior compact 25 of the primary receptacle 20. Nevertheless, the slopped bottom surface 28 of the open interior compartment 25 is defined. The slopped bottom surface 28 is structured and disposed within the primary receptacle 20 so as to lead and/or guide drinking straws thereon towards a generally elongate slot 27 defined in a rear face 29 of the primary receptacle 20. Specifically, the elongate slot 27 is structured and disposed to permit the selective passage of a drinking straw A therethrough when dispensing of one of the drinking straws is necessary.

Figure 1:
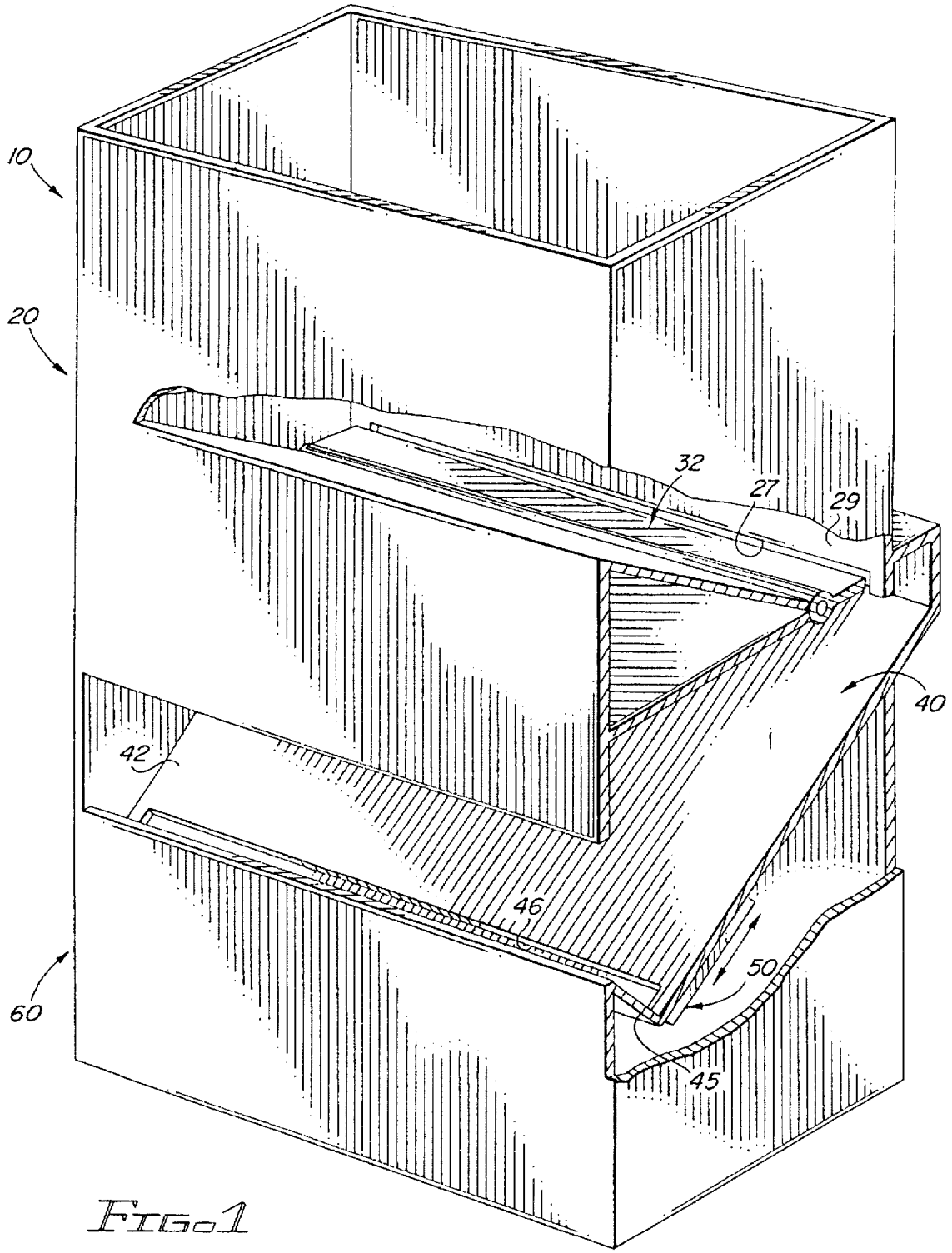
FIG. 1 is a perspective, partial cut-away view of the automatic drinking straw dispensing device of the present invention.

In order to ensure that only one of the drinking straws is permitted to exit the primary receptacle 20 through the elongate slot 27 at one time, the present invention further includes single straw dispensing means 32. The single straw dispensing means 32 are disposed in at least partially covering relation over the elongate slot 27 such that unless actuated a drinking straw contained within the primary receptacle will not be able to pass through the elongate slot 27. In a first preferred embodiment, as illustrated in FIGS. 1, 2 and 4, the single straw dispensing means 32 includes a dispensing stopper 34. In particular, the dispensing stopper 34 is preferably at least one plate or panel positioned to block off the elongate slot 27. Although the single straw dispensing means 32, and in particular the dispensing stopper 34 may be disposed outside of the primary receptacle 20, in a variety of orientations and configurations, it is preferred that the dispensing stopper 34 be pivotally secured to an interior of the primary receptacle 20.

Furthermore, the dispensing stopper 34 is structured to move between an open and a closed orientation, wherein the closed orientation is structured to resist the movement of the drinking straw through the elongate slot 27, and the open orientation permits free movement of the drinking straw through the elongate slot 27. In the preferred embodiment, the dispensing stopper 34 is connected with actuation means 36 structured to open and close the dispensing stopper. In particular, the actuation means 36 are preferably connected to the dispensing stopper 34 by an elongate wire or biased spring 37 such that upon actuation the wire 37 pulls on the dispensing stopper 37, holding it in the open orientation long enough to permit a single drinking straw to be dispensed through the elongate slot 27. Subsequently, the actuation means 36 release the dispensing stopper 34 such that it may return to its normal, closed orientation. In this regard, it should be noted that a variety of sensors or like means could be incorporated to detect when a single drinking straw has been permitted to pass through the elongate slot 27 and cause the dispensing stopper 34 to return to its closed orientation; however, a timed opening and closing is generally sufficiently accurate. Additionally, the actuation means 36 may be connected with the vending machine's controls in order to direct opening upon the dispensing of an article by the machine, or alternatively an independent switch may be included.

Turning to FIG. 3, in an alternative embodiment the single straw dispensing means 32' include at least one slotted drum 38. Specifically, the slotted drum 38, as with the dispensing stopper 34 may be a single elongate element extending across the entire length of the elongate slot 27, or may merely be one or more distinct elements disposed in a spaced relation from one another along a length of the elongate slot 27 so as to prevent the drinking straw from passing therethrough. Looking specifically to the slotted drum 38, it is structured to include at least one slot 39 defined in a perimeter surface thereof. The slot 39 is structured to receive one of the drinking straws therein for subsequent dispensing. Specifically, the slotted drum 38 may be disposed exterior of the elongate slot 27, such that as a drinking straw exits the elongate slot 27 only one is permitted to pass at a time into a corresponding slot 39 disposed in confronting relation with the elongate slot 27. Alternatively, as illustrated in FIG. 3, the slotted drum 38 may be disposed completely or partially within the primary receptacle 20, so as to receive a drinking straw within one of the slots 39 and rotate that single straw until it is in communication with the elongate slot 27 and may essentially be dumped therethrough for subsequent dispensing. Of course, any actuation means sufficient to selectively rotate the slotted drum 38 a sufficient amount to expose only the next slot 39 at one time will be sufficient to ensure that only a single drinking straw is dispensed at one time.

Disposed in dispensing communication with the elongate slot 27 is a dispensing platform 40. Specifically, the dispensing platform 40 is disposed so that drinking straws which pass through the elongate slot 27 are naturally directed onto the dispensing platform 40. In the preferred embodiment, disposed between the elongate slot 27 and the dispensing platform 40 is a dispensing ramp 44. The dispensing ramp 44 is configured to ensure that a dispensed one of the drinking straws which passes through the elongate slot 27 is directed onto an upper end 41 of the dispensing platform 40. In the preferred embodiment, the dispensing platform 40 includes a generally slopped orientation such that the dispensed one of the drinking straws will naturally slide or roll to a front end 42 of the dispensing platform 40 where the dispensing straw A' is maintained in an accessible, retrievable orientation. Furthermore, it is noted that once in the accessible, retrieval orientation, the dispensed drinking straw A' is maintained in a generally longitudinal position, thereby permitting a user to grasp a central region of the drinking straw A', and further functioning to minimize an overall depth of the dispensing platform 40 and a depth of the overall automatic drinking straw dispensing device 10 from its front surface to its rear surface.

Looking in greater detail to the dispensing platform, it preferably includes an upwardly ramped front lip 45 that functions to retain the dispensed drinking straw A' at generally the front end 42 of the dispensing ramp 40, and further prevents the drinking straw from merely rolling off the dispensing platform 40 as it is dispensed through the elongate slot 27. Moreover, the dispensing platform 40 and a bottom surface 30 of the primary receptacle 20 generally define an open retrieval area 48 into which the user's hand can extend in order retrieve the dispensed drinking straw A' conveniently held therein on the dispensing platform 40.

As previously recited, the single straw dispensing means 32 are preferably structured to be actuated upon a purchase being made at the vending machine 85 and a beverage being dispensed, although it may have an independent switching mechanism actuated by a user. Because in the preferred embodiment, a drinking straw will be dispensed regardless of whether the previously dispensed drinking straw was retrieved by an earlier user, the present invention further includes recycling means. It should be noted that various sensors and the like may also be incorporated in order to determine whether a drinking straw is present on the dispensing platform 40, and thereby halt dispensing of a subsequent straw; however, in the preferred embodiment so as to maintain and maximize clean and sanitary conditions, the recycling means are included. In particular, the recycling means are structured and disposed to remove the dispensed one of the drinking straws A' from the dispensing platform 40 if it is not retrieved. This will therefore prevent more than one drinking straw from backing up onto the dispensing platform 40, and will ensure that a fresh one of the drinking straws is always available for retrieval each time a user seeks a straw.

In the preferred embodiment, the recycling means include an elongate recycling slot 46 disposed generally at the front end 42 of the dispensing platform 40. Preferably, the dispensing slot 46 is disposed such that the dispensed one of the drinking straws A' overlies the recycling slot 46 as it waits to be retrieved. Accordingly, disposed in covering relation to the elongate recycling slot 46 is a stopper element 50. Specifically, the stopper element 50 is structured to selectively prevent the dispensed one of the drinking straw A' from passing through the elongate recycling slot 46, and as such is structured to move between an open orientation, wherein the drinking straw is permitted to pass through the elongate recycling slot 46, and a closed orientation, wherein the drinking straw is maintained in a ready to be retrieved orientation at the front end 42 of the dispensing platform 40. The stopper element 50 preferably includes at least one generally elongate plate which is structured to slide, preferably along an underside of the dispensing platform 40, and is retained in place by a mount bracket 52 or like element. The stopper element 50 is also connected to actuation means 54, such as through a wire or biased element 55, such that upon actuation the stopper element 50 will be pulled upwardly along the dispensing platform 40 to expose the elongate recycling slot 46. Conversely, after the dispensed drinking straw has been removed, the actuation means 54 will subsequently release the stopper element 50 and permit it to return to its blocking, closed orientation which prevents a subsequently dispensed drinking straw from automatically falling through the elongate recycling slot 46. In the preferred embodiment, the stopper element 50 is structured to move to its open orientation after a predetermined period of time. For example, the stopper element 50 may be structured to move to its opened orientation 45 seconds after the straw is initially dispensed onto the dispensing platform 40. Such timed recycling, therefore prevents that the drinking straw will remain on the dispensing platform 40 upon the subsequent dispensing of a new straw. Additionally, the stopper element 50 may also be configured so as to move to its opened orientation upon the dispensing of a subsequent beverage and therefore the actuation of the single straw dispensing means 32.

Further, because in an unattended dispensing situation there is always a risk that individuals may wish to tamper with the dispensed drinking straw A', and leave it in a dispensed orientation such that a subsequent, unsuspecting consumer will retrieve it prior to it being removed by the recycling means, the present invention further includes a tamper sensor 57 and 58. Specifically, the tamper sensor 57 and 58, which may include any conventional type of sensor device, such as a light beam or a plurality of light beams extending along an entire front edge of the dispensing platform 40, are structured to detect passage of any object into the retrieval area 48 wherein the dispensed drinking straw is located. In use, the tamper sensors 57 and 58 will be configured such that a predetermined period of time after an object is detected as passing thereby, the recycling means will automatically be actuated and any straw or article contained on the dispensing platform 40 will be recycled. Naturally, such automatic recycling will provide sufficient time for an individual to retrieve the dispensed drinking straw, while ensuring that any object left behind is removed. Along these lines, the recycling means may include a larger opening rather than merely the elongate recycling slot 46, and in fact may include a pivoting front lip 45 which can pivot temporally out of the way to permit any objects on the dispensing platform 40 to slide off the bottom edge thereof.

Disposed so as to collect all drinking straws which are removed by the recycling means from the dispensing platform 40, the recycling means further include a recycling bin 60. The recycling bin 60 includes a generally open interior compartment 61 wherein recycled drinking straws are contained until they may be removed to be discarded or otherwise reused, as will be described subsequently. Further, while the recycling bin 60 may include a completely open upper surface, in the preferred embodiment it includes a generally elongate opening 64 defined in the top face 62 thereof and positioned in communication with the elongate recycling slot 46 such that any object passing therethrough passes into the opening 64 of the recycling bin 60. Additionally, as in FIG. 4, a recycling ramp 66 may further be included so as to guide a recycled drinking straw into the open interior compartment 61 of the recycling bin 60.

Turning to FIG. 4, in an alternative embodiment, the recycling ramp 66 may be structured to pivot and permit redirection of a recycled one of the drinking straws. In particular, in that alternative embodiment of the present invention, reloading means 70 are further included. The reloading means 70 are structured to return unused drinking straws collected in the recycling bin 60' back into the primary receptacle 20 for use. Because, however, in some circumstances, mischievous individuals may return a used drinking straw to the dispensing platform 40 for subsequent recycling, the reloading means 70 are preferably structured so as to discriminate between used and fresh recycled drinking straws. Although, this selection and determination may be achieved by various methods, such as determining whether the drinking straw is wrapped or via other, more elaborate sensing devices, in the preferred embodiment, the recycling ramp 66 will be configured to pivot between a waste orientation, wherein the recycled drinking straw goes into the primary compartment 61 of the recycling bin 60' for subsequent discard, or reload orientation. In particular, in the reload orientation the recycling ramp 66 directs the drinking straw to be reloaded onto a slopped platform 67. Further, the orientation of the recycling ramp 66 is determined based upon the tamper sensors 57 and 58. Specifically, if the tamper sensors 57 and 58 detect any object passing into the dispensing area 48 after the dispensed drinking straw A' has already been retrieved, the recycling ramp 66 will be configured so as to direct any object contained on the dispensing platform 40 to the waste area. If, however, the tamper sensors 57 and 58 do not detect any object passing into the dispensing area 48, such as to retrieve the freshly dispensed drinking straw, the recycling ramp 66 will pivot to direct the dispensed drinking straw towards the reloading means 70.

In the preferred embodiment, a rear face 63 of the recycling bin 60' includes an opening 68 defined therein and structured to receive a drinking straw which moves down along the slopped platform 67 therethrough for subsequent reloading. Specifically, the opening 68 is disposed in communication with the reloading means 70, which preferably includes at least one elongate belt 72 having a number of straw holding ridges 73 defined thereon. The belt 72 is structured to rotate about oppositely disposed pulleys or bearings so as to position one of the ridges 73 to receive a drinking straw exiting the recycling bin 60. The drinking straws which pass onto and are retained by the ridges 73 are then structured to ride up with the movement of the belt 72 until they reach a location above the primary receptacle 20. At that location means to eject the straw from the ridge 73 are included and actuated, thereby directing the drinking straw into the primary receptacle 20 through an aperture 24 defined in a top surface thereof. In the preferred embodiment, a pair of belts 72 are disposed a spaced apart distance from one another so as to capture opposite ends of a drinking straw thereon, and an ejection element 74 is disposed therebetween and structured to urge a drinking straw from its nested position on a ridge 73 once the apex is reached. In this regard, a guide ramp 75 may also be included to ensure that the drinking straw enters the primary receptacle 20.

It should be noted that the present invention can also be configured to be used with stirrers, such as in a coffee or tea vending machine. Additionally, for food vending situations or even for beverage vending situations a rolled napkin assembly may also be structured to be dispensed. In such a rolled napkin assembly, a napkin is bundled into a compact assembly, which may also include other utility items such as a toothpick or even a straw or stirrer, and is positioned with the primary receptacle 20 in the same fashion as a drinking straw. As such, the rolled napkin assembly will as be easily and conveniently dispensed in the same manner as the drinking straw will be dispensed.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An automatic drinking straw dispensing device comprising:

a primary receptacle, said primary receptacle being structured and disposed to contain a plurality of straws therein, a generally elongate slot formed in said primary receptacle and structured to permit the passage of the drinking straws therethrough, a dispensing platform, said dispensing platform being disposed in dispensing communication with said elongate slot such that the drinking straws which pass through said elongate slot are directed onto said dispensing platform, single straw dispensing means structured and disposed to selectively permit only one of the drinking straws to exit said primary receptacle through said elongate slot at one time, said dispensing platform being further structured to retain a dispensed one of the drinking straws in an accessible, retrievable orientation, and recycling means structured and disposed to remove the dispensed one of the drinking straws from said dispensing platform if not retrieved, and thereby prevent more than one of the drinking straws from backing up on said dispensing platform and ensuring that a fresh one of the drinking straws is available for retrieval.

2. An automatic drinking straw dispensing device as recited in claim 1 wherein said primary receptacle includes a generally sloped bottom surface so as to automatically direct the drinking straws towards said elongate slot.

3. An automatic drinking straw dispensing device as recited in claim 1 wherein said dispensing platform is structured to dispose the dispensed one of the drinking straws in a generally longitudinal position, thereby permitting a user to grasp a central region of the dispensed one of the drinking straws, and minimizing a depth of said dispensing platform.

4. An automatic drinking straw dispensing device as recited in claim 1 further including a dispensing ramp disposed between said elongate slot and said dispensing platform, said dispensing ramp being structured to direct a drinking straw to said dispensing platform.

5. An automatic drinking straw dispensing device as recited in claim 1 wherein said dispensing platform is generally sloped such that the dispensed one of the drinking straws is directed towards and retained at generally a front end thereof.

6. An automatic drinking straw dispensing device as recited in claim 1 wherein said recycling means are structured to remove the dispensed one of the drinking straws from said dispensing platform after a predetermined period of time lapses.

7. An automatic drinking straw dispensing device as recited in claim 1 wherein said recycling means are structured to remove the dispensed one of the drinking straws from said dispensing platform after approximately forty five seconds.

8. An automatic drinking straw dispensing device as recited in claim 1 wherein said recycling means further includes a recycling bin structured to collect the dispensed one of the drinking straws after it is removed from said dispensing platform.

9. An automatic drinking straw dispensing device as recited in claim 1 wherein said recycling means further includes a tamper sensor structured and disposed to detect passage of any object to or from said dispensing platform and direct the removal of the dispensed one of the drinking straws from said dispensing platform after a predetermined period of time if passage of an object is detected, thereby preventing tampering with the dispensed one of the drinking straws.

10. An automatic drinking straw dispensing device as recited in claim 1 wherein said recycling means includes an elongate recycling slot disposed in said dispensing platform and structured to receive the dispensed one of the drinking straws from said dispensing platform therethrough if not retrieved.

11. An automatic drinking straw dispensing device as recited in claim 10 wherein said recycling means includes a stopper element structured to selectively prevent the dispensed one of the drinking straws from passing through said elongate recycling slot.

12. An automatic drinking straw dispensing device as recited in claim 11 wherein said stopper element is structured to move and permit the dispensed one of the drinking straws to enter said elongate recycling slot after a predetermined period of time.

13. An automatic drinking straw dispensing device as recited in claim 11 wherein said recycling means further includes a recycling bin structured to collect the dispensed one of the drinking straws after it passes through said elongate recycling slot.

14. An automatic drinking straw dispensing device as recited in claim 13 wherein said recycling means further includes a recycling ramp disposed between said recycling slot and said recycling bin so as to direct the dispensed one of the drinking straws from said elongate recycling slot to said recycling bin after its passage therethrough.

15. An automatic drinking straw dispensing device as recited in claim 14 wherein said recycling ramp is further structured to selectively direct the dispensed one of the drinking straws to either said recycling bin or a reloading area.

16. An automatic drinking straw dispensing device as recited in claim 13 further including reloading means structured and disposed to return a fresh one of the drinking straws collected in said recycling bin back into said primary receptacle.

17. An automatic drinking straw dispensing device as recited in claim 11 wherein said recycling means further includes a tamper sensor structured and disposed to detect passage of any object to or from said dispensing platform and direct said stopper element to permit the dispensed one of the drinking straws to enter said elongate recycling slot after a predetermined period of time if an object is detected to have passed said tamper sensor, thereby preventing tampering with the dispensed one of the drinking straws.

18. An automatic drinking straw dispensing device as recited in claim 1 wherein said dispensing platform and said primary receptacle are substantially shallow so as to facilitate mounting to an interior door surface of a vending machine.

19. An automatic drinking straw dispensing device as recited in claim 1 wherein said single straw dispensing means includes at least one dispensing stopper disposed to at least partially cover said elongate dispensing slot and thereby resist movement of one of the drinking straws onto said dispensing platform unless opened.

20. An automatic drinking straw dispensing device as recited in claim 19 wherein said dispensing stopper is structured to move and permit the dispensing of one of the drinking straws upon an item being dispensed by a vending machine with which the automatic drinking straw dispensing device is connected.

21. An automatic drinking straw dispensing device as recited in claim 1 wherein said single straw dispensing means includes at lease one slotted drum having at least one slot defined therein and structured to receive one of the drinking straws for subsequent release onto said dispensing platform upon selective rotation of said slotted drum.

22. An automatic drinking straw dispensing device as recited in claim 1 further structured to dispense a stirrer.

23. An automatic drinking straw dispensing device as recited in claim 1 further structured to dispense a rolled napkin assembly.

* * * * *